US007604155B2

(12) United States Patent
Bossel et al.

(10) Patent No.: US 7,604,155 B2
(45) Date of Patent: Oct. 20, 2009

(54) PACKAGING UNIT COMPRISING POUCH AND OUTER PACKAGING

(75) Inventors: Daniel Bossel, Schaffhausen (CH); Peter Kanscar, Zurich (CH)

(73) Assignee: Alcan Technology & Management Ltd., Neuhausen am Rheinfall (CH)

( * ) Notice: Subject to any disclaimer, the term of this patent is extended or adjusted under 35 U.S.C. 154(b) by 208 days.

(21) Appl. No.: 11/602,351

(22) Filed: Nov. 21, 2006

(65) Prior Publication Data

US 2007/0151888 A1 Jul. 5, 2007

(30) Foreign Application Priority Data

Nov. 24, 2005 (EP) ..... 05405666

(51) Int. Cl.
*B65D 3/00* (2006.01)

(52) U.S. Cl. ..... 229/117.32; 206/525; 229/117.12; 383/104

(58) Field of Classification Search ..... 229/117.27, 229/117.32–117.34, 117.12; 206/216–218, 206/460, 459.5, 525, 736; 383/104, 109, 383/119; 426/115, 122
See application file for complete search history.

(56) References Cited

U.S. PATENT DOCUMENTS 3,344,971 A * 10/1967 Walker ..... 229/117.32

(Continued)

FOREIGN PATENT DOCUMENTS

| | | |
|---|---|---|
| DE | 8437498 | 8/1985 |
| EP | 0533648 | 3/1993 |
| EP | 0686566 | 12/1996 |

*Primary Examiner*—Luan K Bui
(74) *Attorney, Agent, or Firm*—Fisher, Christen & Sabol

(57) ABSTRACT

A packaging unit with a packaging pouch (10) of a flexible film-shaped first material and an essentially shape-stable outer packaging (28) of a second material is such that the outer packaging (28) is tube-shaped with open ends (31, 33) which are situated in a plane perpendicular to a tube axis (z). In a first position, the ends (31, 33) form a hexagon with two parallel sides (a, b) and two pairs of sides (c1, c2; d1, d2) each enclosing an angle $\alpha<180°$ lying symmetrically mirror imaged to a plane of symmetry (E), and in a second position form a rectangle with two parallel sides (a, b) and two sides (c, d) lying perpendicular to the plane of symmetry (E). In the first position a straight folding edge (g, h) runs between the corners of the sides (a, b) of both ends (31, 33) lying mirror imaged symmetrical to the plane of symmetry (E), and in the second position the sides (a, b) of both ends lying mirror image symmetrical to the plane of symmetry (E) form an angle $\alpha=180°$. In the first and second position curved folding edges (l, k; l, m) run between the corners of the sides (a, b) of both ends (31, 33) lying parallel to the plane of symmetry (E) in such a manner that, in the second position, the outer faces (37, 39) of the outer packaging (28) extending between the sides (a, b) of both ends (31, 33) lying parallel to the plane of symmetry (E) are curved in a convex manner and the outer faces (41, 43) of the outer packaging (28) extending between the sides (c, d) of both ends (31, 33) lying perpendicular to the plane of symmetry (E) are curved in a concave manner. By pressing together the straight folding edges (g, h), the outer packaging (28) can be moved from the first position into the second position. One end (31) of the outer packaging (28) provides the pouch (10) with a means for standing up the pouch (10) projecting out of the other end (33) with a removable opening part (26), and the packaging pouch (10) situated in the outer packaging in a longitudinal direction (l) of the pouch corresponding to the tube axis (z), is attached at least partially to the inner side of the outer packaging (28).

23 Claims, 4 Drawing Sheets

Figure 1:
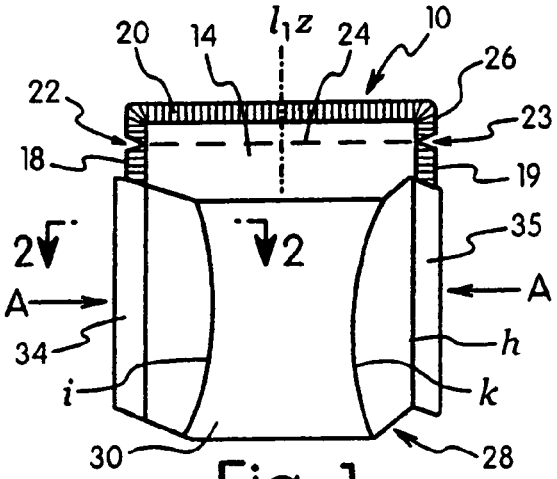

U.S. PATENT DOCUMENTS 3,373,917 A * 3/1968 Cox ..... 229/117.27
3,640,381 A * 2/1972 Kanada et al. ..... 229/117.32
4,196,034 A * 4/1980 Kimura ..... 383/104
4,284,205 A * 8/1981 Hirata ..... 229/117.32
4,391,366 A * 7/1983 Hirata ..... 206/218
4,948,932 A 8/1990 Clough
2003/0080117 A1 5/2003 Chisholm
2003/0080119 A1 5/2003 Chisholm
2003/0080120 A1 5/2003 Whitmore et al.

* cited by examiner

PACKAGING UNIT COMPRISING POUCH AND OUTER PACKAGING

This subject application is claiming priority based on European Application No. 05 405 666.8, which was filed on Nov. 24, 2005.

The invention relates to a packaging unit with a pouch-type packaging of a flexible, film-shaped first material and an essentially shape-stable outer packaging of a second material.

Known for portion packaging of drinkable and/or spoonable products such as fruit juices, water or soups are rigid or shape-stable containers—normally made of plastic by three-dimensional thermoforming or injection moulding—with sealed-on lid and rigid pouches made from plastic laminate. Such packaging containers and pouches are, because of the increased amount of material required, not ideal from the ecological standpoint and are also relatively expensive. Further, the packaging, serving as advertising medium, is normally printed on with result there is basically a risk of migration of undesirable materials into the contents.

A further disadvantage of known pouch forms of packaging is that after heating in a microwave oven they cannot be grasped by the naked hand.

Beakers with sealed on lid have the disadvantage that they are bulky and easily damaged.

The object of the invention is to provide a form of packaging both for drinkable and for spoonable products such as fruit juices, water or soups and for products having liquid and solid or semi-solid products such as animal foodstuffs which do not or only to a slight degree exhibit the above disadvantages of state-of-the-art forms of packaging That objective is achieved by way of the invention in that for a packaging unit of the kind described at the start, the outer packaging is tube-shaped with open ends in a plane perpendicular to a tube axis and the ends, in a first position form a hexagonal with two parallel and two pairs of sides enclosing an angle $\alpha<180°$, mirror imaged to a plane of symmetry and, in a second position, form a rectangle with two parallel sides and two sides lying perpendicular to the plane of symmetry, whereby in the first position a straight folding line runs between the corners of the sides of both ends lying mirror imaged to the plane of symmetry, and in the second position the sides of both ends lying mirror imaged to the plane of symmetry form an angle $\alpha=180°$, and in the first and second position curved folding lines run between the corners of both sides of both ends lying parallel to the plane of symmetry in such a manner that, in the second position, the outer faces of the outer packaging extending between the sides of both ends lying parallel to the plane of symmetry are curved in a convex manner and the outer faces of the outer packaging extending between the sides of both ends lying perpendicular to the plane of symmetry are curved in a concave manner, whereby the outer packaging can be moved from the first position into the second position by pressing together the straight folding lines such that one end of the outer packaging offers a face for standing the packaging pouch with opening part projecting out of the other end, and the pouch situated in the outer packaging in a longitudinal direction of the pouch corresponding to the tube axis is attached at least in part to the inner side of the outer packaging.

A basic advantage of the packaging unit according to the invention is on the one hand that the flat shape of the pouch in the first position is excellent for transportation, and on the other hand, the beaker-shaped, shape-stable form in the second position is ideal for removing the contents.

The pouch material and the material of the outer packaging are, with respect to the contents, preferably organoleptic and chemically neutral monolithic materials.

A useful design of the packaging unit according to the invention is such that the outer packaging exhibits a front wall and a rear wall and the outer packaging walls are joined together in the longitudinal direction of the pouch via sealing edges running along the side. The pouch may exhibit a front wall and a rear wall which are likewise joined together in the longitudinal direction of the pouch via sealing edges running along the side. In this case the side sealing edges of the pouch are usefully sealed into the sealing edges of the outer packaging or e.g. adhesively bonded in at spots using hot-melt adhesive.

The packaging pouch preferably exhibits an opening part along a tear line lying transverse to the longitudinal direction of the pouch, in order that an opening for removing the contents is formed at the separated opening part by pressing on the sides of the straight folding edges of the outer packaging.

The packaging pouch itself may be a tube pouch or an extruded pouch. The pouch material for the pouch according to the invention may, in comparison with the rigid material required for a self-standing pouch with its own self-standing properties, exhibit a smaller thickness and is therefore more cost-favourable. Because of the shape-stable second position of the outer packaging, the opening formed after removing the opening part by pressure on the straight folding edges of the outer packaging remains wholly and permanently open.

The pouch material of the pouch-type packaging according to the invention is preferably a single or multi-layer material, if desired a plastic film laminated with a paper layer, or a paper laminated with plastic, and is preferably in the form of a monolithic material.

In order to prevent migration of foreign substances into the interior of the pouch, the packaging material is preferably not printed on.

The outer packaging material may be of any cost-favourable monolithic material. Cardboard or a transparent or opaque plastic is a preferred outer packaging material. The outer packaging may be printed on as desired.

The packaging pouch is particularly suitable for packaging drinkable or spoonable contents, also contents containing liquid for drinking or spoonable contents that can be stirred. A further preferred field of application is for the packaging of contents which are intended for heating in a microwave oven. The packaging is also suitable for packaging foodstuffs for animals and for other products such as e.g. washing powders and other pourable solids.

The heating of the foodstuffs e.g. soups may be carried out in the microwave oven in the opened packaging pouch according to the invention together with the outer packaging if desired after stirring with cold water. The advantage of the packaging unit according to the invention lies in the thermally insulating outer packaging which makes it possible to grasp the package with the naked hand.

In the case of water with and without carbon dioxide, the packaging system serves the purpose of containing the contents and at the same time acting as a vessel for drinking from.

Depending on the kind of contents, this is stirred with water e.g. soups with hot water, or the contents are already in the liquid or spoonable form e.g. yogurt.

Figure 3:
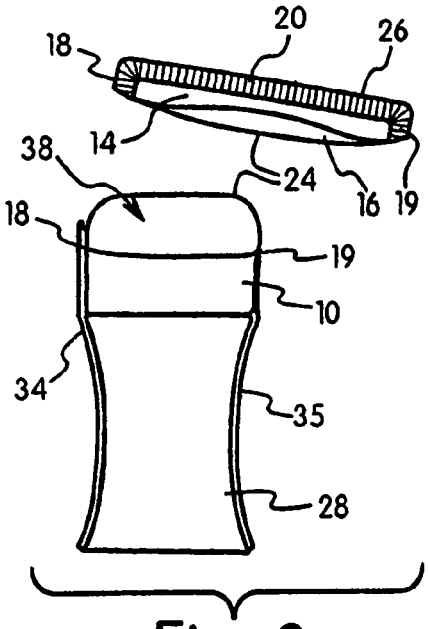
Figure 2:
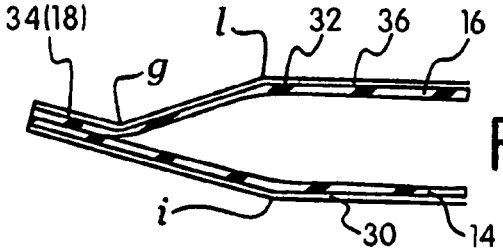
Figure 4:
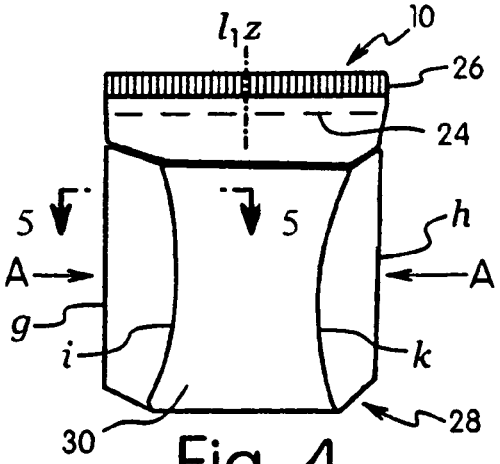
Figure 6:
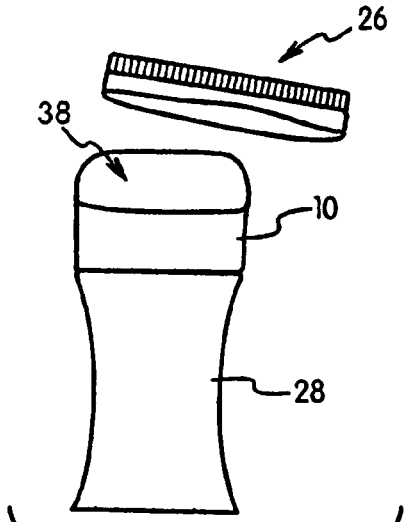
Figure 5:
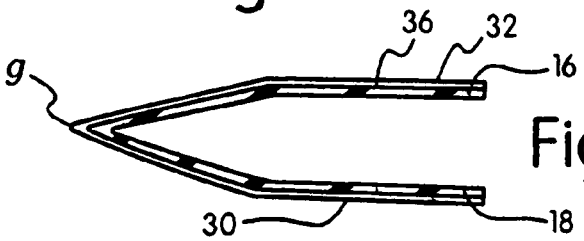
Figure 7:
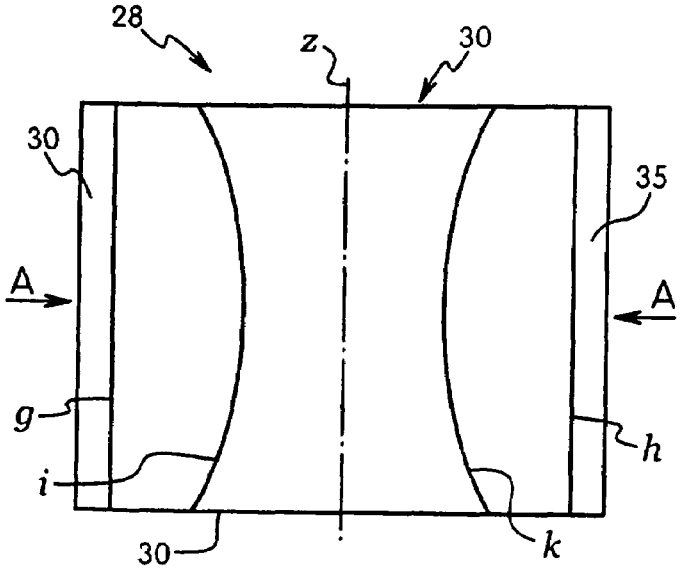
Figure 9:
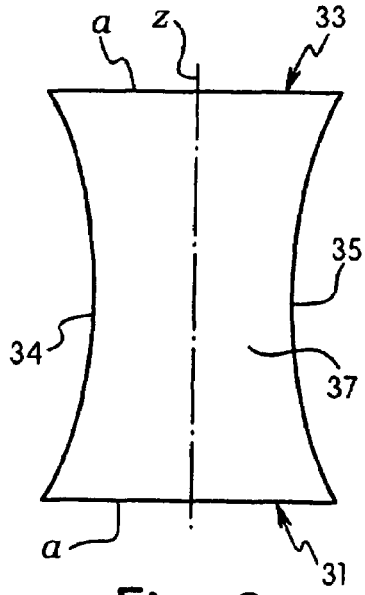
Figure 8:
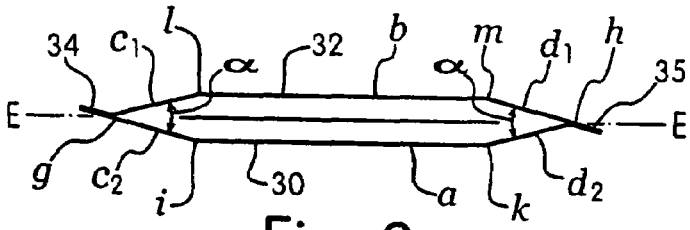
Figure 11:
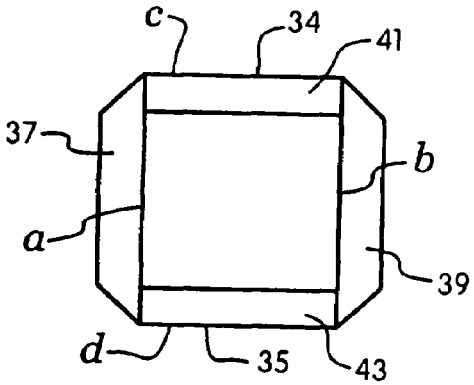
Figure 10:
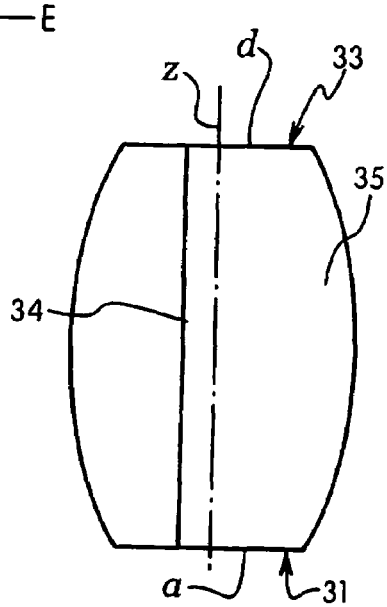
Figure 12:
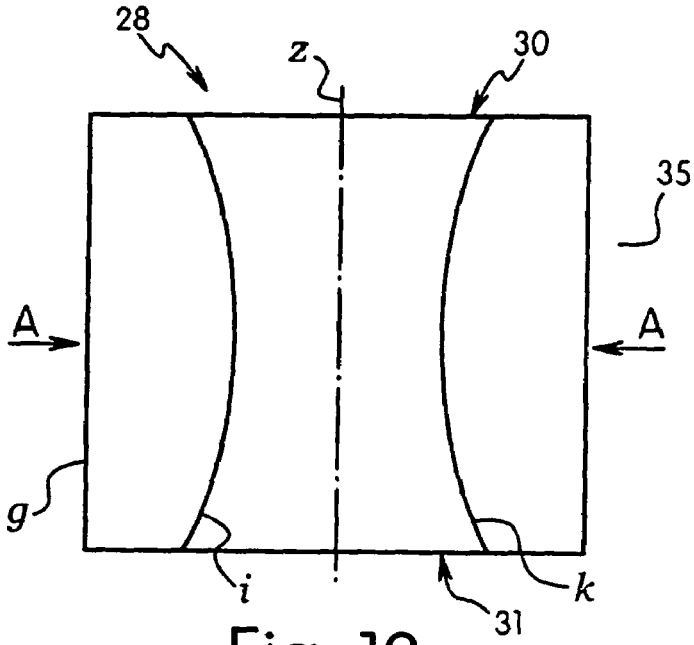
Figure 14:
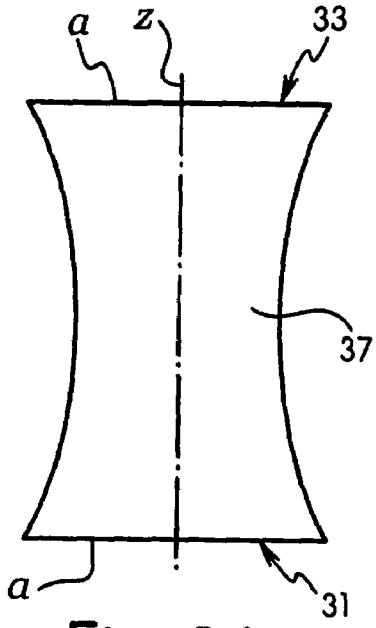
Figure 13:
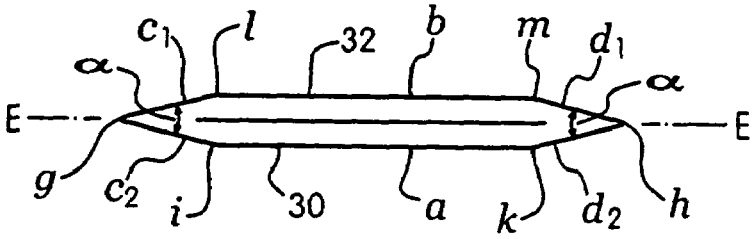
Figure 16:
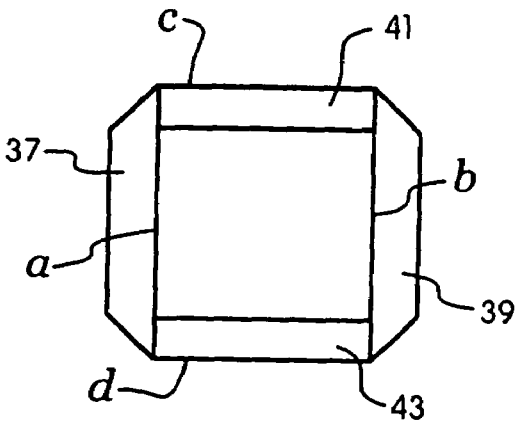
Figure 15:
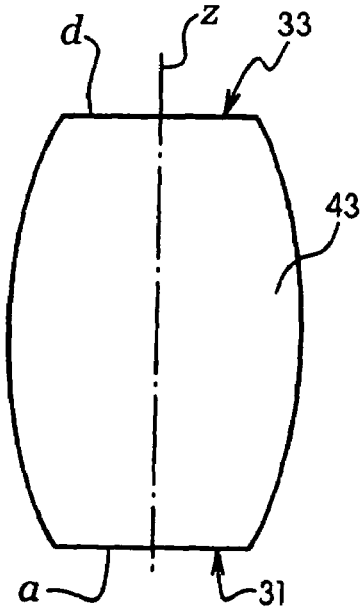
Figure 17:
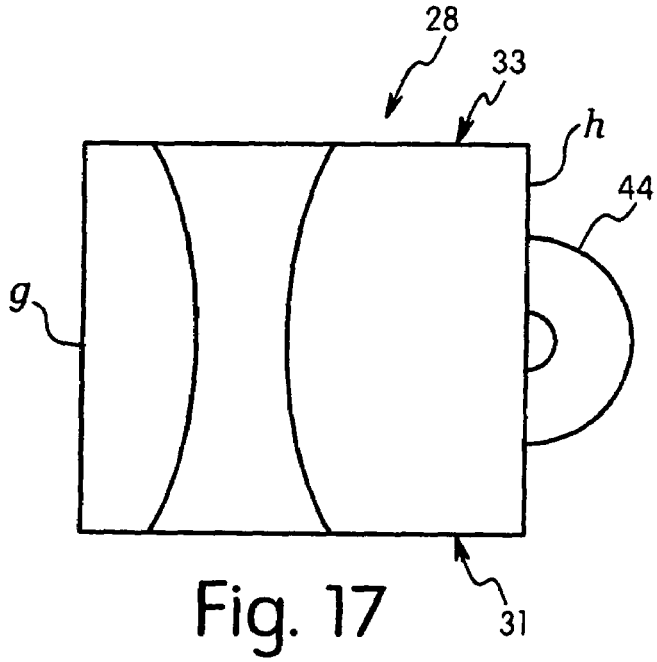
Figure 19:
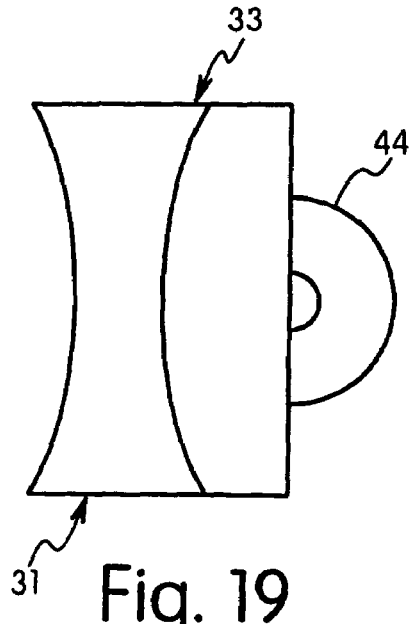
Figure 18:
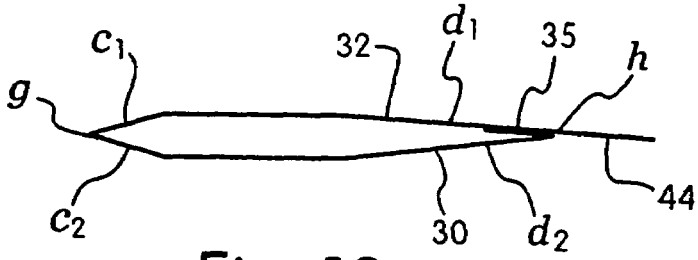
Figure 20:
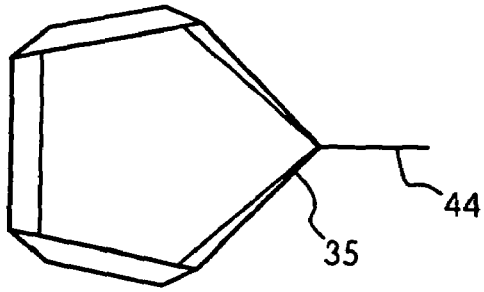

Further advantages, features and details of the invention are revealed in the following description of preferred exemplified embodiments and with the aid of the drawing which shows schematically in:

FIG. 1 a perspective view of a first version of a packaging pouch with outer packaging in a first position;

FIG. 2 a section through a part of the packaging pouch with outer packaging in FIG. 1 along line 2-2 and enlarged;

FIG. 3 a perspective view of a packaging pouch with outer packaging shown in FIG. 1 in a second position with separated opening part;

FIG. 4 a perspective view of a second version of a packaging pouch with outer packaging;

FIG. 5 a section, through a part of the packaging pouch with outer packaging shown in FIG. 4, along line 5-5 and enlarged;

FIG. 6 a perspective view of the packaging pouch with outer packaging shown in FIG. 4 in a second position with a separated opening part;

FIG. 7 end view of the outer packaging in FIG. 1 shown in the first position;

FIG. 8 plan view of the outer packaging shown in FIG. 7;

FIG. 9 end view of the packaging in FIG. 7 shown in the second position;

FIG. 10 end view of the outer packaging shown in FIG. 9 turned about 90°;

FIG. 11 plan view of the outer packaging shown in FIG. 10;

FIG. 12 end view of the outer packaging shown in FIG. 4 in the first position;

FIG. 13 plan view of the outer packaging shown in FIG. 12;

FIG. 14 end view of the outer packaging shown in FIG. 12 in the second position;

FIG. 15 end view of the outer packaging shown in FIG. 14 turned about an angle of 90°;

FIG. 16 plan view of the outer packaging shown in FIG. 15;

FIG. 17 an end view of another version of the outer packaging shown in FIG. 4 in the first position, corresponding to that shown in FIG. 12;

FIG. 18 plan view of the outer packaging shown in FIG. 17;

FIG. 19 end view of the outer packaging in FIG. 18 shown in the second position;

FIG. 20 plan view of the outer packaging shown in FIG. 19

A packaging unit shown in FIGS. 1 to 3 comprises a packaging pouch 10 and an outer packaging 28. The pouch 10 in the form of a self-standing pouch of flexible film material such as e.g. polyamide, exhibits a sealed-in base, which is not seen in the drawing, a front wall 14 and a rear wall 16.

Two longitudinal sealing seams 18, 19, arranged at the sides and defining the longitudinal direction l of the pouch 10, join together the pouch walls 14, 16 extending up from the base and, together with a transverse sealing seam 20 joining the longitudinal sealing seams 18, 19 at the end remote from the base, complete the closed packaging pouch 10.

The transverse sealing seam 20 at the end remote from the base of the pouch 10 is a part of an opening part 26 which can be separated from the pouch 10. To open the pouch 10, the opening part 26 is torn away along a tear line 24 provided in the pouch walls 14, 16 a short distance from the transverse seam 20. As an aid to tearing notches 22, 23 are provided in the longitudinal sealing seams 18, 19 with peaks terminating at the tear line 24.

The tube-shaped outer packaging made of essentially shape-stable material such as cardboard, the open ends 31, 33 of which lie parallel to each other and perpendicular to a tube axis z, encloses the pouch 10 in a fist position, shown in FIG. 1, with a front wall 30 and a rear wall 32, extends from its base over the pouch walls 14, 16 towards the opening part 26 and terminates a short distance from the tear line 24. The longitudinal direction l of the pouch 10 lies along the tube axis z of the outer packaging 28. One end 31 of the tube-shaped outer packaging 28 serves as a base for the packaging unit to stand on, so that the pouch 10 itself need not be designed to be self-standing. The pouch 10 may therefore be a simple tube-shaped pouch with one longitudinal seam, or an extruded pouch without seam, and two transverse seams.

The front wall 30 and the rear wall 32 of the outer packaging 28 are joined together via two side seams 34, 35 running in the direction z of the tube or in the longitudinal direction l of the pouch 10. On sealing the two outer packaging walls 30, 32, the longitudinal seams 18, 19 of the pouch 10, arranged between the front wall 30 and the rear wall 32 of the outer packaging 28, sealed in there (FIG. 2).

The pouch 10 arranged in the outer packaging 28 is attached, at least partially, to the inner side of the outer packaging 28. The attachment of the pouch walls 14, 16 to the inner side of the outer packaging 28, in particular at the edge close to the opening part 26 of the pouch 10, is made e.g. partially via adhesive spots 36.

In the first position, the open ends 31, 33 of the outer packaging 28 form a hexagon with two sides a and b lying parallel to a plane of symmetry E, and two pairs of sides c1, c2 and d1, d2 each enclosing an angle $\alpha<180°$ mirror imaged symmetrical to the plane of symmetry E.

Running between the corners of the sides c1, c2 and d1, d2 of both ends 31, 33 lying mirror-imaged symmetrical to the plane of symmetry is a straight folding line g, h. One folding line g is arranged in the rear wall 32 of the outer packaging 28 as a limiting line to the seam 34, the other folding edge h in the front wall 30 as a limiting line to seam 35.

Arc-shaped curved folding edges i, k and l, m, run between the corners of the sides a, b of both ends 31, 33 lying parallel to the plane of symmetry.

In a second position shown in FIG. 3, the open ends 31, 33 form a rectangle with the two sides a, b lying parallel to the plane of symmetry E and two sides c, d lying perpendicular to the plane of symmetry E made up of the hexagon sides c1, c2 and d1, d2 forming an angle $\alpha=180°$.

As shown in FIGS. 7-11, the transformation of the outer packaging 28 from the first position to the second position is achieved by pressing together the straight folding edges g, h or the sealing seams 34, 35 in the direction of the arrow A. Thereby, the outer faces 37, 39 of the outer packaging 28 extending between the sides a, b of both ends 31, 33 lying parallel to the plane of symmetry E are curved as a pair to convex curved faces and the outer faces extending between the sides c, d lying perpendicular to the plane of symmetry E are curved as a pair to concave curved faces. When the outer packaging 28 is in the second position, the sealing seams 34, 35 rest against the concave curved outer faces 41, 43.

The packaging unit shown in FIGS. 4-6 differ from the unit in FIGS. 1-3 by way of the different construction of the outer packaging 28 out of a one-piece part e.g. of cardboard. In this case the pouch 10 is attached to the inner side of the outer packaging 28 at least at its edge close to opening part 26 e.g. partially or adhesive spot-bonded places 36.

Here, as shown in FIGS. 12-16, the second position of the outer packaging 28 results from pressing together the straight folding edges g, h in direction A, by means of which the outer faces 37, 39 of the outer packaging 28, extending between the sides a, b of ends 31, 33 lying parallel to the plane of symmetry E are curved as a pair to convexly curved faces and the outer faces 41, 43 extending between the sides c, d lying perpendicular to the plane of symmetry E are curved as a pair to concave curved faces. In this version of the outer packaging 28 there are no sealing seams present, therefore, on pressing the straight line folded edges g, h together, shortly before reaching the second position, the outer faces spontaneously arrive at concave curved final shape which is stable in shape.

The second position of the outer packaging in FIGS. 7-11 and 12-16 has e.g. the following dimensions:

| | |
|---|---|
| Height H | 80 mm |
| First breadth A1 of the open ends 31, 33 | 50 mm |
| Second breadth B1 of the open ends 31 33 | 35 mm |
| First breadth A2 at half height (40 mm) | 35 mm |
| Second breadth B2 at half height (40 mm) | 50 mm |

Starting from these dimensions, all uniformly symmetrical enlarged or reduced shapes lead to ideal outer packaging forms with respect to the formation and stability of the second position. Of course, other forms of different proportions are also possible. Further possible forms with proportions differing from those of the ideal form can be determined by means of simple experimentation.

Shown in FIGS. 17-20 is a special version of an outer packaging 28. Here a part of the rear wall 32 projects out beyond the straight edge h in the form of a gripping means 44. The folding edge h runs as a limiting line to a narrow strip 35 in the front wall 30 adhesively bonded to the inside of the rear wall 32 to form the tube-shaped outer packaging 28. The sides d1, d2 of the open ends 31, 33 neighbouring the grip are shorter than the further removed sides c1, c2. On pressing together on the straight folding edges g, h a concave outer face is produced only on the side opposite the grip, with the result that the ends 31, 33 of the outer packaging 28 form a pentagon. In the first position a packaging unit with a packaging pouch 10 and an outer packaging 28 according to FIGS. 17-20 yields a flat pouch-type form of packaging and in the second position a cup.

In all versions of the invention, on tearing off the opening part 28 or on opening the pouch 10 by cutting away the end of the pouch, an opening 38 is created in the packaging pouch 10, which by pressing together the straight folding edges g, h or the sealing seams 34, 35 of the outer packaging 28 in direction A, can be adjusted to the maximum opening size given by the second position.

The invention claimed is:

1. A packaging unit with a packaging pouch (10) of a flexible film-shaped first material and an essentially shape-stable outer packaging (28) of a second material, wherein the outer packaging (28) is tube-shaped with open ends (31, 33) are situated in a plane perpendicular to a tube axis (z) and, in a first position, the ends (31, 33) form a hexagon with two parallel sides (a, b) and two pairs of sides (c1, c2; dl, d2) each enclosing an angle $\alpha<180°$ lying symmetrically mirror-imaged to a plane of symmetry (E), and in a second position form a rectangle with two parallel sides (a, b) and two sides (c, d) lying perpendicular to the plane of symmetry (E), whereby in the first position a straight folding edge (g, h) runs between the corners of the two parallel sides (a, b) of both ends (31, 33) lying mirror imaged symmetrical to the plane of symmetry (E), and in the second position the two parallel sides (a, b) of both ends lying mirror image symmetrical to the plane of symmetry (E) form an angle $\alpha=180°$, and in the first and second position curved folding edges (l, k; l, m) run between the corners of the parallel sides (a, b) of both ends (31, 33) lying parallel to the plane of symmetry (E) in such a manner that, in the second position, the outer faces (37, 39) of the outer packaging (28) extending between the two parallel sides (a, b) of both ends (31, 33) lying parallel to the plane of symmetry (E) are curved in a convex manner and the outer faces (41, 43) of the outer packaging (28) extending between the two sides (c, d) of both ends (31, 33) lying perpendicular to the plane of symmetry (E) are curved in a concave manner, whereby, by pressing together the straight folding edges (g, h), the outer packaging (28) can be moved from the first position into the second position, the one end (31) of the outer packaging (28) provides the packaging pouch (10) with a means for standing up the packaging pouch (10) projecting out of the other end (33) with a removable opening part (26), and the packaging pouch (10) situated in the outer packaging in a longitudinal direction (I) of the packaging pouch corresponding to the tube axis (z), is attached at least partially to the inner side of the outer packaging (28).

2. The packaging unit according to claim 1, wherein the outer packaging (28) exhibits a front wall (30) and a rear wall (32) and the outer packaging walls (30, 32) are joined together in the longitudinal direction (I) of the two packaging pouch (10) by way of sealing seams (34, 35) at the two sides (c, d).

3. The packaging unit according to claim 2, wherein the packaging pouch (10) exhibits a front wall (14) and a rear wall (16) which are joined together by way of sealing edges (18, 19) running at the two parallel sides (a, b) in the longitudinal direction (I) of the packaging pouch (10), and the sealing edges (18, 19) of the packaging pouch at the sides are sealed or adhesively bonded into the sealing edges (34, 35) of the outer packaging (28).

4. The packaging unit according to claim 1, wherein the packaging pouch (10) exhibits a removable opening part (26) lying along a tear line (24) transverse to the longitudinal direction (I) of the packaging pouch (10), such that when the opening part (26) has been removed an opening (38) for removing the contents is formed by applying pressure sideways to the straight folding edges (g, h) on the outer packaging (28).

5. The packaging unit according to claim 1, wherein the packaging pouch material is a single or multi-layer laminated film of plastic, if desired laminated with paper, or a paper laminated with plastic and is preferably in the form of a monolithic material.

6. The packaging unit according to claim 1, wherein the packaging pouch (10) is not printed on.

7. The packaging unit according to claim 1, wherein the outer packaging material is cardboard or a transparent or opaque plastic and is preferably in the form of a monolithic material.

8. The packaging unit according to claim 1, wherein the outer packaging (28) is printed on.

9. The packaging unit according to claim 1, wherein the packaging pouch (10) is attached to the inner wall of the outer packaging (28) by way of adhesive bonding at spot (36).

10. The packaging unit according to claim 1, wherein the packaging pouch (10) is a self-standing pouch, a tube-type pouch or an extruded pouch.

11. A process of utilizing the packaging unit according to claim 1 for packaging drinkable or spoonable contents and for animal foodstuffs.

12. A process of utilizing the packaging unit according to 1 for packaging stirrable contents that are drinkable or spoonable with fluids.

13. A process of utilizing the packaging unit according to claim 1 for packaging contents intended for heating in a microwave oven.

14. The packaging unit according to claim 3, wherein the packaging pouch (10) exhibits a removable opening part (26) lying along a tear line (24) transverse to the longitudinal direction (I) of the packaging pouch (10), such that when the opening part (26) has been removed an opening (38) for removing the contents is formed by applying pressure sideways to the straight folding edges (g, h) on the outer packaging (28).

15. The packaging unit according to claim 13, wherein the packaging pouch material is a single or multi-layer laminated film of plastic, if desired laminated with paper, or a paper laminated with plastic and is preferably in the form of a monolithic material.

16. The packaging unit according to claim 14, wherein the packaging pouch (10) is not printed on.

17. The packaging unit according to claim 15, wherein the outer packaging material is cardboard or a transparent or opaque plastic and is in the form of a monolithic material.

18. The packaging unit according to claim 16, wherein the outer packaging (28) is printed on.

19. The packaging unit according to claim 17, wherein the packaging pouch (10) is attached to the inner wall of the outer packaging (28) by way of adhesive bonding at spot (36).

20. The packaging unit according to claim 18, wherein the packaging pouch (10) is a self-standing pouch, a tube-type pouch or an extruded pouch.

21. A process of utilizing the packaging unit according to claim 19 for packaging drinkable or spoonable contents and for animal foodstuffs.

22. A process of utilizing the packaging unit according to claim 19 for packaging stirrable contents that are drinkable or spoonable with fluids.

23. A process of utilizing the packaging unit according to claim 19 for packaging contents intended for heating in a microwave oven.

* * * * *